US006729921B1

(12) United States Patent
Ishii

(10) Patent No.: US 6,729,921 B1
(45) Date of Patent: May 4, 2004

(54) CATALYZER ARRANGEMENT IN OUTBOARD MOTOR

(75) Inventor: Yasushi Ishii, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/591,745

(22) Filed: Jun. 12, 2000

(30) Foreign Application Priority Data

Aug. 31, 1999 (JP) ..... 11-245110

(51) Int. Cl.[7] ..... B63H 21/32
(52) U.S. Cl. ..... 440/89
(58) Field of Search ..... 123/195 R; 440/88, 440/89, 76, 77; 60/302, 298, 299

(56) References Cited

U.S. PATENT DOCUMENTS

| | | | | |
|---|---|---|---|---|
| 4,452,194 | A | | 6/1984 | Watanabe |
| 4,735,046 | A | | 4/1988 | Iwai |
| 4,848,082 | A | | 7/1989 | Takahashi et al. |
| 4,900,282 | A | | 2/1990 | Takahashi et al. |
| 5,174,112 | A | | 12/1992 | Sougawa et al. |
| 5,239,825 | A | | 8/1993 | Shibata |
| 5,280,708 | A | | 1/1994 | Sougawa et al. |
| 5,324,217 | A | | 6/1994 | Mineo |
| 5,346,417 | A | | 9/1994 | Isogawa |
| 5,372,530 | A | | 12/1994 | Holtermann et al. |
| 5,378,180 | A | | 1/1995 | Nakayama et al. |
| 5,439,651 | A | | 8/1995 | Kato |
| 5,494,467 | A | | 2/1996 | Sohgawa et al. |
| 5,702,276 | A | | 12/1997 | Nakase et al. |
| 5,743,774 | A | | 4/1998 | Adachi et al. |
| 5,822,985 | A | | 10/1998 | Yoshimura |
| 5,911,608 | A | | 6/1999 | Nakayama et al. |
| 5,911,609 | A | | 6/1999 | Fujimoto et al. |
| 5,911,610 | A | * | 6/1999 | Fujimoto ..... 440/89 |
| 6,053,785 | A | | 4/2000 | Kato et al. |

FOREIGN PATENT DOCUMENTS

| | | |
|---|---|---|
| EP | 0 779 206 A1 | 12/1996 |
| JP | 6-193441 | of 1994 |
| JP | 7-189671 | of 1995 |
| JP | 9-49424 | 2/1997 |
| JP | 2901097 | of 1999 |

* cited by examiner

*Primary Examiner*—Ed Swinehart
(74) *Attorney, Agent, or Firm*—Knobbe, Martens, Olson & Bear LLP

(57) ABSTRACT

A catalyzer arrangement in an outboard motor includes an improved construction that does not require a large space for furnishing a catalyzer having a relatively large volume and that keeps the catalyzer away from the body of water in which the outboard motor is operated. The outboard motor includes an engine having an internal or external exhaust section. A driveshaft housing of the motor is adapted to be mounted on an associated watercraft. An exhaust guide is mounted on the driveshaft housing for supporting the engine. The exhaust guide includes an internal exhaust section coupled to the exhaust section of the engine. An exhaust unit defines an internal exhaust section that is coupled to the exhaust section of the exhaust guide. The exhaust unit includes a catalyzer disposed in its internal exhaust section.

33 Claims, 5 Drawing Sheets

CATALYZER ARRANGEMENT IN OUTBOARD MOTOR

PRIORITY INFORMATION

This application is based on and claims priority to Japanese Patent Application No. 11-245110, filed Aug. 31, 1999, the entire contents of which is hereby expressly incorporated by reference.

BACKGROUND OF THE INVENTION

1. Field of the Invention

This invention relates to a catalyzer arrangement, and more particularly to an improved catalyzer arrangement suitable to an outboard motor.

2. Description of Related Art

A typical outboard motor has an engine atop thereof for powering a propulsion device. A protective cowling surrounds the engine. The engine and protective cowling together define the power head of the outboard motor. A driveshaft housing depends from the power head for supporting a driveshaft that extends from a crankshaft of the engine. A lower unit depends from the driveshaft housing for carrying the propulsion device, such as, for example, a propeller that is driven by the driveshaft through the propulsion shaft. The engine is provided with an exhaust system to discharge exhaust gases from the motor.

A typical exhaust system includes generally three exhaust passages. The first passage is disposed within the engine or on the engine and within the protective cowling to lead the exhaust gases from the engine. The second passage is disposed within the driveshaft housing and the lower unit for guiding the exhaust gases to the third passage and also for silencing exhaust noise by passing the exhaust gases through at least one expansion chamber. The third passage is defined within a hollow hub of the propeller and terminates at a discharge port formed at the end of the hub. Normally, an idle exhaust passage with an idle discharge port is additionally provided in the driveshaft housing above the body of water that surrounds the outboard motor. The majority of the exhaust gases are discharged to the body of water through the discharge port of the propeller hub, while the idle exhaust gases are discharged to the atmosphere through the idle discharge port.

It is quite important for environmental concerns to remove hydrocarbons and the like from exhaust gases. For at least this reason, the exhaust gases often are purified with a catalyzer that is disposed within the exhaust system. The catalyzer includes components that chemically react with the exhaust gases in a manner that renders certain of the exhaust gas constituents substantially environmentally harmless. The larger the catalyzer is, the greater its efficiency is; however, because the engine is surrounded by the protective cowling, space is at a premium and limited areas are available for positioning the catalyzer. If the engine has multiple cylinder bores, properly positioning the catalyzer becomes more difficult. Moreover, if a large single catalyzer or small multiple catalyzers are used to treat exhaust gases coming from the respective cylinder bores, finding adequate space within the cramped confines of the cowling becomes very difficult.

In one arrangement, such as that disclosed by U.S. Pat. No. 5,239,825, a catalyzer arrangement for a multiple cylinder engine features a single catalyzer that is disposed in the first exhaust passage and sideward of the engine. Although the arrangement is compact, the catalyzer is somewhat bulky.

U.S. Pat. No. 5,378,180 discloses another arrangement in which a catalyzer is disposed also in the first exhaust passage but rearward of an engine. This type of arrangement, however, requires a large amount of space rearward of the engine. It is undesirable to expand the motor rearward because such a construction would make handling of the motor more difficult. Additionally, if the engine operates on a four-stroke combustion principle, a voluminous valve system is disposed in this space and consumes a majority of the available area.

U.S. Pat. Nos. 5,174,112 and 5,280,708 disclose further arrangements of catalyzers. The catalyzers in these patents are disposed in the second exhaust passages that are positioned within the driveshaft housing. Although a relatively large capacity is available with the catalyzer in this arrangement, the catalyzer is likely positioned proximate the water line. As is known, catalyzers can be fouled or shattered by contact with water. Accordingly, positioning the catalyzers proximate the water line is disadvantageous due to the possibility of water back flow through the exhaust system. Thus, catalyzers preferably are positioned well above the water line or the exhaust system preferably includes a shelter that can protect the catalyzers from water contact.

A need therefore exists for an improved catalyzer arrangement that does not require a large space for furnishing a catalyzer that has a relatively large volume, and that does not expose the catalyzer toward the body of water without any particular protection.

SUMMARY OF THE INVENTION

In accordance with one aspect of the present invention, an outboard motor comprises an internal combustion engine. The engine includes a first exhaust section. A driveshaft housing is adapted to be mounted on an associated watercraft. A support member is mounted on the driveshaft housing for supporting the engine above the driveshaft housing. An exhaust unit is disposed to the side of the support member. The exhaust unit defines a second exhaust section coupled to the first exhaust section. A catalyzer is disposed in the second exhaust section.

In accordance with another aspect of the present invention, an outboard motor comprises an internal combustion engine. The engine includes a first exhaust section. A driveshaft housing is adapted to be mounted on an associated watercraft. A support member is mounted on the driveshaft housing for supporting the engine. An exhaust unit is mounted on the support member. The exhaust unit defines a second exhaust section coupled to the first exhaust section. A catalyzer is disposed in the second exhaust section.

In accordance with a further aspect of the present invention, an exhaust gas purifying system is provided for an outboard motor. The outboard motor has an internal combustion engine and a support member supporting the engine. The exhaust gas purifying system comprises a first exhaust section. The first exhaust section extends through both the engine and the support member. A second exhaust section is coupled to the first exhaust section and extends out of the support member. A third exhaust section is coupled to the second exhaust section and extends through the support member. A catalyzer is disposed in the second exhaust section.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

DETAILED DESCRIPTION OF THE PREFERRED EMBODIMENTS OF THE INVENTION

Figure 1:
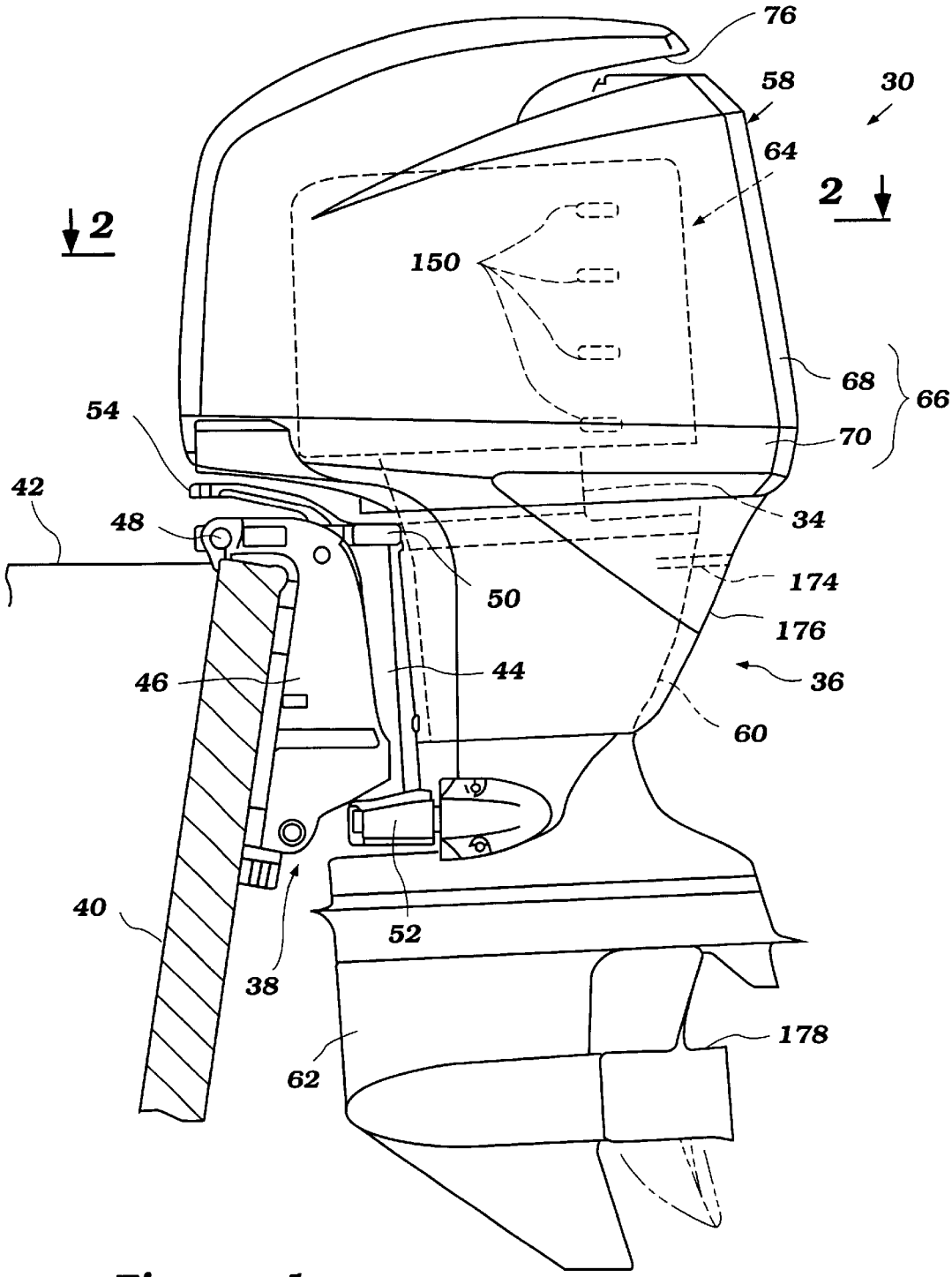
FIG. 1 is a side elevational view of an outboard motor that employs an exhaust unit configured in accordance with a preferred embodiment of the present invention. An associated watercraft on which the motor is mounted is partially shown in section.
Figure 2:
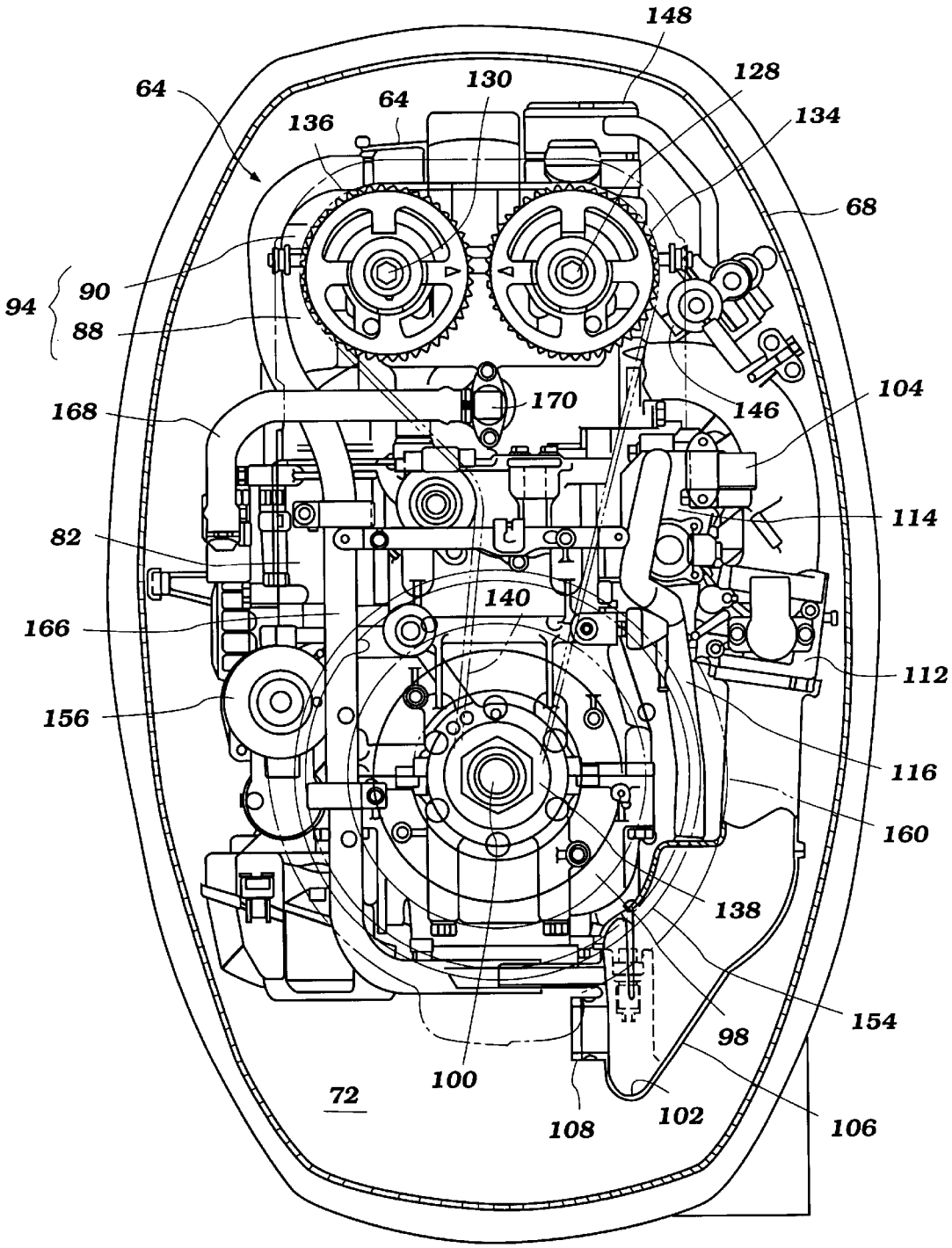
FIG. 2 is a top plan view of the outboard motor. A top cowling is sectioned along the line 2—2 of FIG. 1.
Figure 3:
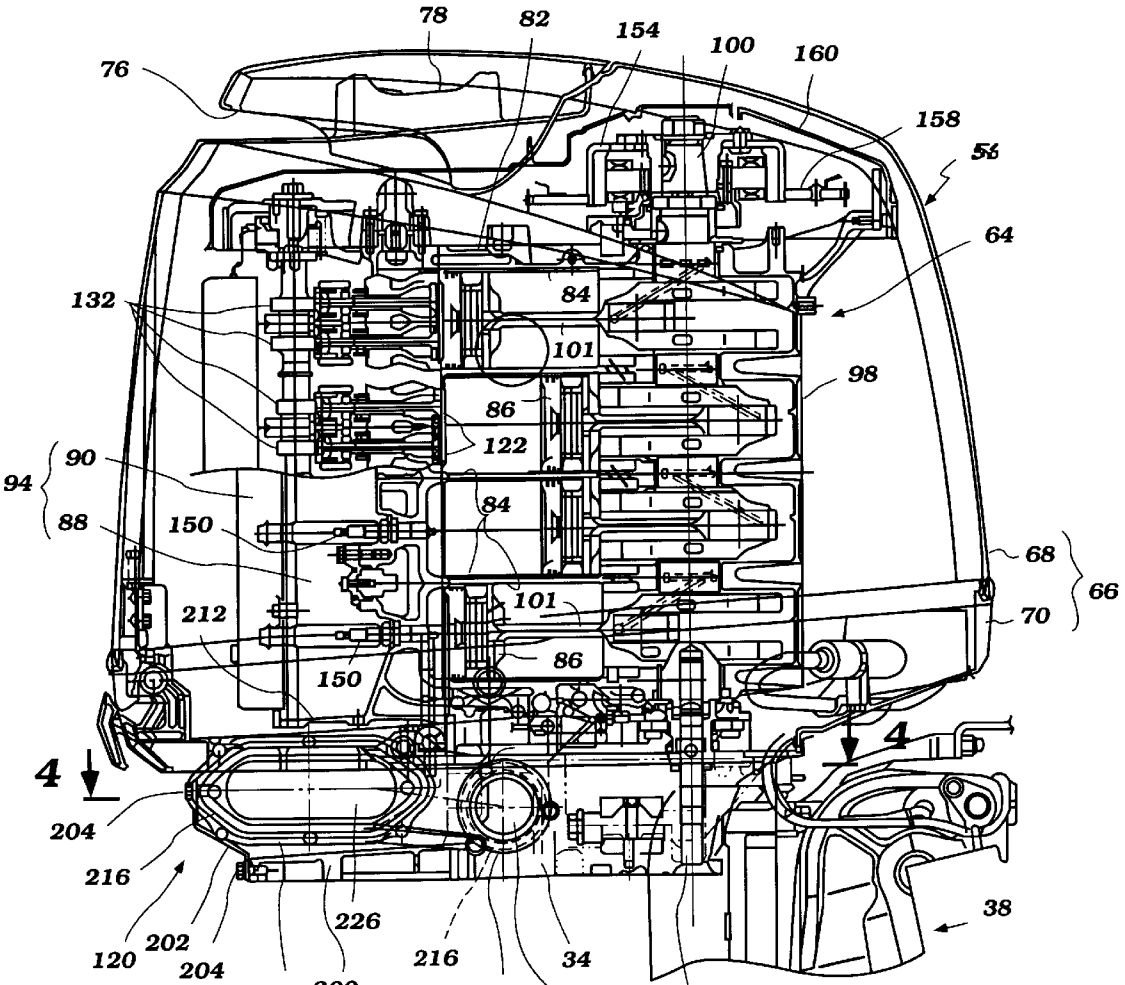
FIG. 3 is a side elevational view of a power head, an exhaust guide and a portion of a bracket assembly of the motor of FIG. 1. The engine is generally shown in cross-section, and the protective cowling is illustrated in section.
Figure 4A:
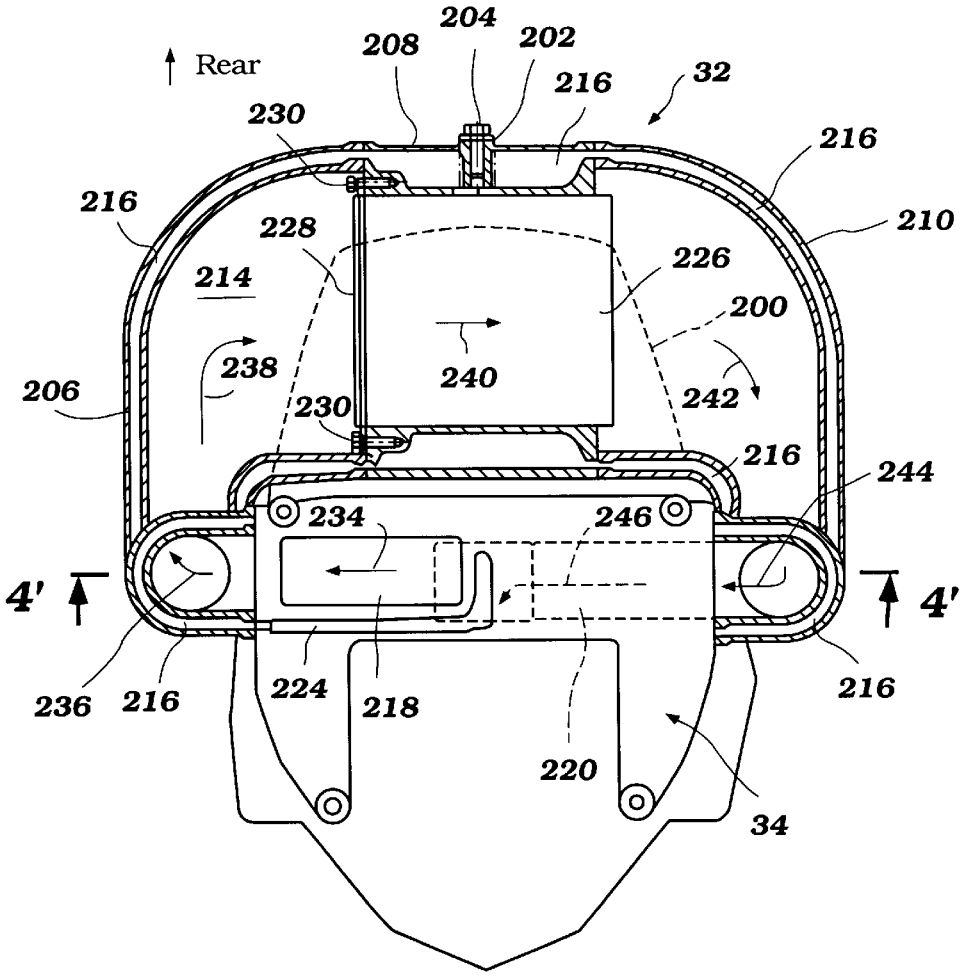
FIG. 4(A) is a combined view including a top plan view of the exhaust guide and a cross-sectional view of the exhaust unit taken generally along the line 4—4 of FIG. 3.
Figure 4B:
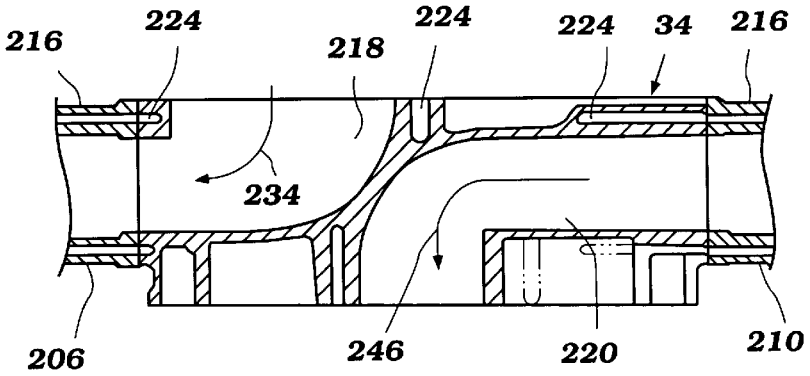
FIG. 4(B) is a cross-sectional view taken along the line 4'—4' of FIG. 4(A).

With reference to FIGS. 1 to 3, an outboard motor 30 employs an exhaust unit 32 (see FIGS. 3 and 4(A)) configured in accordance with a preferred embodiment of the present invention. The exhaust unit 32 is mounted on an exhaust guide or support member 34 of the motor 30.

In the illustrated embodiment, the outboard motor 30 comprises a drive unit 36 and a bracket assembly 38. The bracket assembly 38 supports the drive unit 36 on a transom 40 of an associated watercraft 42 so as to place a marine propulsion device in a submerged position with the watercraft 42 resting on the surface of a body of water. The bracket assembly 38 comprises a swivel bracket 44, a clamping bracket 46, a steering shaft and a pivot pin 48.

The steering shaft extends through the swivel bracket 44 and is affixed to the drive unit 36 with an upper mount assembly 50 and a lower mount assembly 52. The steering shaft is pivotally journaled for steering movement about a generally vertically extending steering axis within the swivel bracket 44. A steering handle 54 extends upwardly and forwardly from the steering shaft to steer the drive unit 36. The clamping bracket 46 includes a pair of bracket arms spaced apart from each other and affixed to the watercraft transom 40. The pivot pin 48 completes a hinge coupling between the swivel bracket 44 and the clamping bracket 46. The pivot pin 48 extends through the bracket arms so that the clamping bracket 46 supports the swivel bracket 44 for pivotal movement about a generally horizontally extending tilt axis of the pivot pin 48.

As used through this description, the terms "front," "forward" and "forwardly" mean at or to the side where the clamping bracket 46 is located, and the terms "rear," "rearward," "rearwardly" and "reverse" mean at or to the opposite side of the front side, unless indicated otherwise or otherwise readily apparent from the context of use.

Although not shown, a hydraulic tilt system is provided between the swivel bracket 44 and the clamping bracket 46 to tilt up and down and also for the trim adjustment of the drive unit 36.

Since the construction of the bracket assembly 38 is well known in the art, a further description is not believed to be necessary to permit those skilled in the art to practice the invention.

The drive unit 36 includes a power head 58, a driveshaft housing 60 and a lower unit 62. The power head 58 is disposed atop of the drive unit 36 and includes an internal combustion engine 64 and a protective cowling assembly 66. The protective cowling assembly 66 includes a top cowling member 68 and a bottom cowling member 70.

The cowling assembly 66 generally completely encloses the engine 64. That is, the cowling assembly 66 defines a generally closed cavity 72 to contain the engine 64 therein. The top cowling member 68 is detachably affixed to the bottom cowling member 70 so that the operator can make access to the engine 64 for maintenance or for other purposes. The top cowling member 68 includes an air intake opening 76 at a rear portion of the top cowling member 68 and an air intake duct 78 (FIG. 3) disposed internally of the opening 76. The ambient air can be introduced into the cavity 72 through the opening 76 and the intake duct 78.

The bottom cowling 70 has an opening at its bottom portion through which the exhaust guide 34 extends. The exhaust guide, i.e., the support member, 34 is affixed atop of the driveshaft housing 60. That is, the support member is mounted on the driveshaft housing 60. The bottom cowling 70 and the exhaust guide 34, thus, generally form a tray. The engine 64 is placed on this tray and is affixed to the exhaust guide exhaust guide 34 has exhaust passages. The exhaust guide 34 and its exhaust passages will be described in greater detail below with reference to FIGS. 4(A) and (B).

The engine 64 in the illustrated embodiment operates on a four-stroke combustion principle and powers a propulsion device. The engine 64 has a cylinder body 82. The cylinder body 82 defines four cylinder bores 84 which are spaced apart from each other generally vertically and which extend generally horizontally. That is, the engine 64 is a L4 (in-line four cylinder) type. This type of engine, however, is merely exemplary of a type on which various aspects and features of the present invention can be used. Engines having other number of cylinders, having other cylinder arrangements, and operating on other combustion principals (e.g., crankcase compression two-stroke or rotary) are all practicable.

A piston 86 can reciprocate in each cylinder bore 84. A cylinder head member 88 is affixed to one end of the cylinder body 82 to define combustion chambers 89 with the pistons 86 and the cylinder bores 84. A cylinder head cover member 90 is affixed to the cylinder head member 88 to cover it. The cylinder head member 88 and cylinder head cover member 90 together form a cylinder head assembly 94.

The other end of the cylinder body 82 is closed with a crankcase member 98 defining a crankcase chamber with the cylinder bores 84. A crankshaft 100 extends generally vertically through the crankcase chamber. The crankshaft 100 is rotatably connected to the pistons 86 by connecting rods 101 and rotates with the reciprocal movement of the pistons 86.

The crankcase member 98 is located at the most forward position, then the cylinder body 82 and the cylinder head assembly 94 extend rearwardly from the crankcase member 98 one after another.

The engine 64 includes an air induction system. The air induction system is arranged to supply air charges to the combustion chambers 89 and comprises a plenum chamber 102, main air delivery conduits 104 and intake ports. The intake ports are defined in the cylinder head member 88 and are opened and closed by intake valves. When each intake port is opened, the corresponding air delivery conduit 104 communicates with the associated combustion chambers 89.

The plenum chamber 102 functions as an intake silencer and/or a coordinator of air charges. A plenum chamber member 106 defines the plenum chamber 102 and is mounted on the port side of the crankcase member 98. The plenum chamber member 106 has an air inlet opening 108 that opens to the cavity 72. The air delivery conduits 104 extend rearwardly from the plenum chamber member 106 along the cylinder body 82 on the port side and then bend toward the intake ports. Air is taken into the plenum chamber 102 through the inlet opening 108 from the cavity 72 and is supplied to the combustion chambers 89 through the delivery conduits 104 and the intake ports.

The main air delivery conduits 104 include throttle bodies 112. The respective throttle bodies 112 support butterfly-type throttle valves therein for pivotal movement about axes of valve shafts extending generally vertically. The valve shafts are linked together to form a single valve shaft that passes through the entire throttle bodies 112. The throttle valves are operable by the operator through a suitable throttle cable and a linkage mechanism so that the valves allow proper amounts of air to pass through the respective delivery conduits 104 in response to the engine operations. When the operator operates the throttle cable, the linkage mechanism activates the valve shaft to open the throttle valves. Conversely, when the throttle cable is released, the linkage mechanism activates the valve shaft to close the throttle valves.

The air induction system further includes an idle air supply unit 114. The idle air supply unit 114 bypasses the throttle valves. An upstream bypass conduit 116 couples the unit 114 with the plenum chamber member 106, while a downstream bypass conduit 118 couples the unit 114 with one of the delivery conduits 104. The idle air supply unit 114 contains a valve member pivotally disposed therein. When the throttle valves in the throttle bodies 112 are almost closed at idle, the valve member in the idle air supply unit 114 is operated so as to supply the necessary air to the combustion chambers 89 under control of an ECU (Engine Control Unit), which is an electrically operable control device.

The engine 34 includes an exhaust system that includes the exhaust unit 32. The exhaust system is arranged to discharge exhaust gases outside of the outboard motor 30 from the combustion chambers 89. Exhaust ports are defined in the cylinder head member 88 and are opened or closed by exhaust valves 122. The cylinder body 82 defines an exhaust manifold internally that is arranged downstream of the exhaust ports. When the exhaust ports are opened, the combustion chambers 89 communicate with the exhaust manifold. The exhaust manifold thus gathers the exhaust gases to guide them to the exhaust passage of the exhaust guide 34 that will be described shortly. The exhaust gases are discharged out of the motor 30 through the exhaust passage and other succeeding exhaust sections.

An intake camshaft 128 and an exhaust camshaft 130 extend generally vertically and in parallel with each other to actuate the intake valves and the exhaust valves 122, respectively. The camshafts 128, 130 have cam lobes 132 thereon to push the intake valves and the exhaust valves 122 at certain timings to open and close the intake ports and exhaust ports. The camshafts 128, 130 are journaled on the cylinder head assembly 94 and are driven by the crankshaft 100. The respective camshafts 128, 130 have sprockets 134, 136 thereon, while the crankshaft 100 also has a sprocket 138 thereon. A timing belt or chain 140 is wound around the sprockets 134, 136, 140. With rotation of the crankshaft 100, the camshafts 128, 130 rotate also. A tensioner 142 is also provided to adjust the tension of the belt or chain 140 by pushing it inwardly so as to keep the opening and closing timing of the intake valves and the exhaust valves 122 accurate. The tensioner 142 includes, for example, a gas cylinder containing compressed gases therein to produce the tensioning force.

In the illustrated embodiment, the engine 64 has a fuel injection system, although any other conventional fuel supply and change forming systems can be applied. The fuel injection system includes four fuel injectors 146 which have injection nozzles directed to the respective intake ports. The fuel injectors 146 are supported by a fuel rail that is affixed to the cylinder head member 88. The fuel injection system further includes a vapor separator, several fuel pumps, a pressure regulator, a fuel supply tank, a fuel filter and several fuel conduits connecting those components. Generally the fuel supply tank is disposed on a hull of the watercraft 42 and the other components are placed on the outboard motor 30. One of the fuel pumps is a high pressure pump 148 mounted on the cylinder head cover member 90. An amount of each fuel injection and injection timing are controlled by the ECU.

The engine 64 further has a firing system. Four spark plugs 150 are mounted on the cylinder head member 88 so as to expose their electrodes to the respective combustion chambers 89. The spark plugs 150 can be installed and removed from the rear side of the engine 64 by detaching the top cowling member 68 from the bottom cowling member 70. This is the same side on which the exhaust unit 32 is provided. That is, the exhaust unit 32 is affixed to the exhaust guide 34 on its rear side.

The spark plugs 150 fire an air/fuel charge in the combustion chambers 89 at a proper timing. This firing timing is also controlled by the ECU. The air/fuel charge is formed with an air charge supplied by the main air delivery conduits 104 or the idle air supply unit 114 and a fuel charge is sprayed by the fuel injectors 146. The burnt charge or exhaust gases are discharged outside through the exhaust system as described above.

A flywheel assembly 154 is affixed atop the crankshaft 100. The flywheel assembly 154 includes a generator to supply electric power to the firing system, to the ECU and to other electrical equipment via a battery usually disposed in the hull of the watercraft 42. A starter motor 156 is mounted on the cylinder body 82 adjacently to the flywheel assembly 154. A gear of the starter motor 154 is meshed with a ring gear 158 that is provided on a periphery of the flywheel assembly 154 through a one-way clutch. The starter motor 156 rotates the crankshaft 100 via the flywheel assembly 154 when the operator operates a main switch. Because, however, the starter gear and the ring gear 158 are coupled together by the one-way clutch, the crankshaft 100 cannot rotate the starter motor 156 immediately after starting of the engine 64. A protector 160 covers the flywheel assembly 154, starter motor 156, sprockets 134, 136, 138 and the belt 140 for protection of the operator from such moving parts.

The engine 64 has also a lubrication system. A lubricant reservoir depends from the exhaust guide 34 within the driveshaft housing 60. A lubricant pump is driven by the driveshaft to supply lubricant to engine components that need lubrication. The lubricant then drains to the lubricant reservoir. The engine components that need the lubrication include the pistons 86 that furiously reciprocate within the cylinder bores 84. The pistons 86 need the lubrication not to seize on surfaces of the cylinder bores 84. Piston rings are provided on the pistons 86 to isolate the combustion chambers 89 from the crankcase chambers. At least one piston ring can remove the oil from the surface of the cylinder bore 84 and carry it out to the crankcase chamber.

Unburnt charges containing a small amount of the exhaust gas may leak to the crankcase chamber from the combustion chambers 89 as blow-by gas because of the huge pressure generated therein, although the piston rings isolate them. The engine 64 has a ventilation system that delivers the blow-by gases to the induction system to burn them in the combustion chambers 89.

The ventilation system comprises an inner blow-by gas conduit, an oil separator or breather 164 and an outer blow-by gas conduit 166. The inner conduit is formed internally of the crankcase member 98, cylinder body 82 and cylinder head assembly 94 and connects the crankcase chamber with the oil separator 164. The oil separator 164 is mounted on the cylinder head cover member 90 and has a labyrinth structure therein to separate the oil component from the blow-by gases. The outer blow-by gas conduit 166 couples the oil separator 164 to the plenum chamber member 106 so as to supply the blow-by gases to the induction system.

The engine 64 further has a cooling system that provides coolant to engine portions, for example, the cylinder body 82 and the cylinder head assembly 94, and also to the exhaust system because they accumulate significant heat during engine operations. In the illustrated embodiment, water is used as the coolant and is introduced from the body of water surrounding the outboard motor 30, as will be described later.

The water introduced into the cooling system is delivered to the engine portions through cooling water jackets. After cooling them, the water is discharged outside through a discharge conduit 168 and a water discharge jacket formed in the cylinder body 82. A thermostat 170 is provided at the most upstream portion of the discharge conduit 168. If the temperature of the water is lower than a preset temperature, the thermostat 168 will not allow the water to flow out to the discharge conduit 168 so that the engine 64 can warm up properly. The cooling system will be described in more detail later.

With reference back to FIG. 1, the driveshaft housing 60 depends from the power head 58 and supports a driveshaft 172 which is driven by the crankshaft 100 of the engine 64. The driveshaft 172 extends generally vertically through the exhaust guide 34 and then through driveshaft housing 60. The driveshaft housing 60 also defines internal passages which form portions of the exhaust system. An idle exhaust passage 174 is branched off from one of the internal passages and opens to the atmosphere above the body of water. In the illustrated embodiment, an apron 176 covers an upper portion of the driveshaft housing 60. The idle exhaust passage 174 extends through both an outer surface of the driveshaft housing 60 and the apron 176.

The lower unit 62 depends from the driveshaft housing 60 and supports a propulsion shaft which is driven by the driveshaft. The propulsion shaft extends generally horizontally through the lower unit 62. In the illustrated embodiment, the propulsion device supports a propeller 178 that is affixed to an outer end of the propulsion shaft and is driven thereby. The propulsion device, however, can take the form of a dual, a counter-rotating system, a hydrodynamic jet, or like propulsion devices.

A transmission is provided between the driveshaft and the propulsion shaft. The transmission couples together the two shafts which lie generally normal to each other (i.e., at a 90° shaft angle) with a bevel gear train or the like. The transmission has a switchover or clutch mechanism to shift rotational directions of the propeller 178 to forward, neutral or reverse. The switchover mechanism is operable by the operator through a shift linkage including a shift cam, a shift rod and a shift cable.

The lower unit 62 also defines an internal passage that forms a discharge section of the exhaust system. At engine speed above idle, the majority of the exhaust gases are discharged toward the body of water through the internal passage and a hub of the propeller 178. At the idle speed of the engine 64, the exhaust gases can be discharged only through the idle exhaust passage 174 because the exhaust pressure under this condition is smaller than the backpressure created by the body of water.

Additionally, the driveshaft housing 60 has a water pump that is driven by the driveshaft and supplies cooling water to the cooling system. Water is introduced through a water inlet (not shown) which opens at the lower unit 62. The water inlet is connected to the water pump through an inlet passage, while the water pump is connected to the engine portions and the exhaust system.

Still with reference to FIG. 3 and additionally to FIGS. 4(A) and (B), the exhaust unit 32 and its connections with the exhaust system and the cooling system will now be described in great detail. The exhaust unit 32 is mounted on the exhaust guide 34 at its rear side as noted above. Actually, the exhaust guide 34 includes a projection 200 that is connected to the driveshaft housing 60. The exhaust unit 32 is placed in a space formed between the projection 200 and the bottom surface of the cylinder head assembly 94. The exhaust unit 32 is affixed to the exhaust guide 34. A bracket 202 is used to fix the unit 32 onto the projection 200 with bolts 204. The bottom cowling member 70 partially surrounds a top portion of the exhaust unit 32. Also, the exhaust unit 32 exists lower than the spark plug 150 that is placed at the lowermost position and higher than the discharge opening of the idle exhaust passage 174. In the illustrated embodiment, at least a portion of the exhaust unit 32 is placed higher than the driveshaft housing 60.

As seen in FIG. 4(A), the exhaust unit 32 comprises three pieces 206, 208, 210 coupled with each other. These pieces 206, 208, 210 are formed as double jackets. The inner jacket defines an exhaust passage 214, while the outer jacket defines a water passage 216.

The exhaust guide 34, in turn, has two exhaust passages 218, 220. One passage 218 is connected to the exhaust manifold formed internally in the engine 64. The other passage 220 is connected to the internal passage formed in the driveshaft housing 60. The exhaust passages 218, 220 are surrounded by a water jacket 224.

The exhaust passage 214 in the exhaust unit 32 is connected to the exhaust passages 218, 220 at both sides of the exhaust guide 34. Thus, the exhaust passage 214 generally extends around the rear half of the exhaust guide 34 over the projection 200 to form a relatively long straight portion therein. The water passage 216 of the exhaust unit 32 is, also, connected to the water jacket 224 of the exhaust guide 34.

In the illustrated embodiment, the center piece 208 of the exhaust unit 32 supports a monolithic catalyzer 226 because the center piece 208 is completely formed straight. The catalyzer 226 is configured as a cylindrical shape and is enclosed in a metal case except for both end portions thereof. The exhaust passage 214 within the center piece 208 has a slightly narrow inner diameter, while the catalyzer 226 has generally the same outer diameter as the inner diameter of the center piece 208. The center piece 208 thus holds the catalyzer 226 fully with its inner surface. A bracket 228 is coupled with the catalyzer 226 and is affixed to the center piece 208 by screws 230 to securely mount the catalyzer 226 on the center piece 208. The bracket 228 is generally configured as a ring-shape so that the entire surface of the catalyzer 226 confronts the exhaust flow. Thus, the exhaust gases can flow into the catalyzer 226 generally evenly across the end of the catalyzer 226. The bracket 228, however, has a mesh covering this portion.

The catalyzer 226 causes a chemical reaction that renders certain of the exhaust gas constituents harmless. The catalyzer 226 has a carrier member that carries, for example, a three-way catalyst element. The three-way catalyst element can oxidize CO and HC and reduce NOx contained in the exhaust gases. Thus, the gases are purified when passing through the catalyzer 226. It should be noted, however, that any conventional catalyzers can be applied in complying with various purposes and/or regulations.

When the air/fuel charge burns in the combustion chambers 89, a burnt charge or exhaust gases are produced therein. The exhaust gases are discharged from the combustion chambers 89 to the exhaust manifold of the engine 64 through the exhaust ports. The gases then pass down to the exhaust passage 218 of the exhaust guide 34 and move into the exhaust unit 32 as indicated by the arrows 234, 236, 238 of FIGS. 4(A) and (B). Next, the exhaust gases pass through the catalyzer 226 to be purified thereby as indicated by the arrow 240 of FIG. 4(A), and then flow into the exhaust passage 220 of the exhaust guide 34 as indicated by the arrows 242, 244 of FIG. 4(A). The exhaust gases then flow down through the internal passage of the driveshaft housing 60 as indicated by the arrows 246 of FIGS. 4(A) and (B), and further through the internal passage of the lower unit 62. Finally they are discharged through the hub of the propeller 178 to the body of water when the engine 64 operates above idle speed. However, if the engine 64 operates at or below idle speed, the gases move through the idle exhaust passage 174 and out to the atmosphere. Since the entire exhaust gases must pass through the catalyzer 226 whether they go to the body of water or to the atmosphere, harmful constituents of the discharged exhaust gases from the outboard motor are reduced.

Cooling water is supplied to the water passage 216 of the exhaust unit 32 and to the water jacket 224 in the exhaust guide 34 directly by the water pump or indirectly after circulating through the engine portions. The cooling water flows around the exhaust passages 214, 218, 220 to conduct heat away from the exhaust gases passing therethrough and also from the catalyzer 226.

In the illustrated embodiment, the catalyzer 226 is contained in the exhaust unit 32 which is placed in the dead space (i.e., previously unused space) behind the exhaust guide or support member 34 and, more specifically, between the bottom of the engine 64 and the upper surface of the projection 200 of the exhaust guide 34. The exhaust unit 32 also can provide a sufficient length in the center piece 208 to employ the catalyzer 226 that has a relatively large volume. Thus, no special and voluminous space is necessary to be created for furnishing the catalyzer 226.

The catalyzer 226 is located far from the exhaust ports of the engine 64. Because of this, the catalyzer 226 and the bracket 228 will not be damaged by the exhaust gases that contain extremely high temperature.

Also, the catalyzer 226 is confined in the exhaust unit 32 that is attached to the exhaust guide 34. The exhaust passage 214 in the unit 32 is branched from the main exhaust system that passes through the engine 64, exhaust guide 34, driveshaft housing 60 and the lower unit 62. In other words, main sections of an outboard motor such as an engine and a driveshaft housing do not need any change in configuration. Thus, a number of existing outboard motors can easily employ this catalyzer arrangement.

Further, the water passage 216 abuts the catalyzer 226 quite closely and along almost the entire length of the catalyzer 226. The heat of the catalyzer 226 thus can be transferred effectively to the water flowing through the water passage 216.

In addition, because the exhaust unit 32 exists lower than the spark plug 150 placed at the lowermost position, it does not obstruct access to the spark plugs 150.

Also, the unit 32 is positioned higher than the discharge opening of the idle exhaust passage 174. The discharge opening of the idle exhaust passage 174 is surely located above the body of water. The water, therefore, will not reach the exhaust unit 32. Even though some water may splash up to the position where the catalyzer 226 is located, the catalyzer unit 226 is completely contained in the exhaust unit 32 and is well isolated from such water. No particular protection is, therefore, necessary to protect the catalyzer 226 itself from the water. Moreover, the exhaust unit 32 preferably is surrounded by the apron 176 to protect further the exhaust unit 32 and to improve the appearance of the outboard motor 30; however, the exhaust unit 32 can be partially or entirely exposed outside the apron 176.

The exhaust passage 226 is entirely surrounded by the water passage 216. This arrangement is advantageous because not only are exhaust gases efficiently cooled but also an outer shell of the exhaust unit 32 is cooled. Thus, a part of or the entire exhaust unit can be exposed out of the protective cowling.

Figure 5:
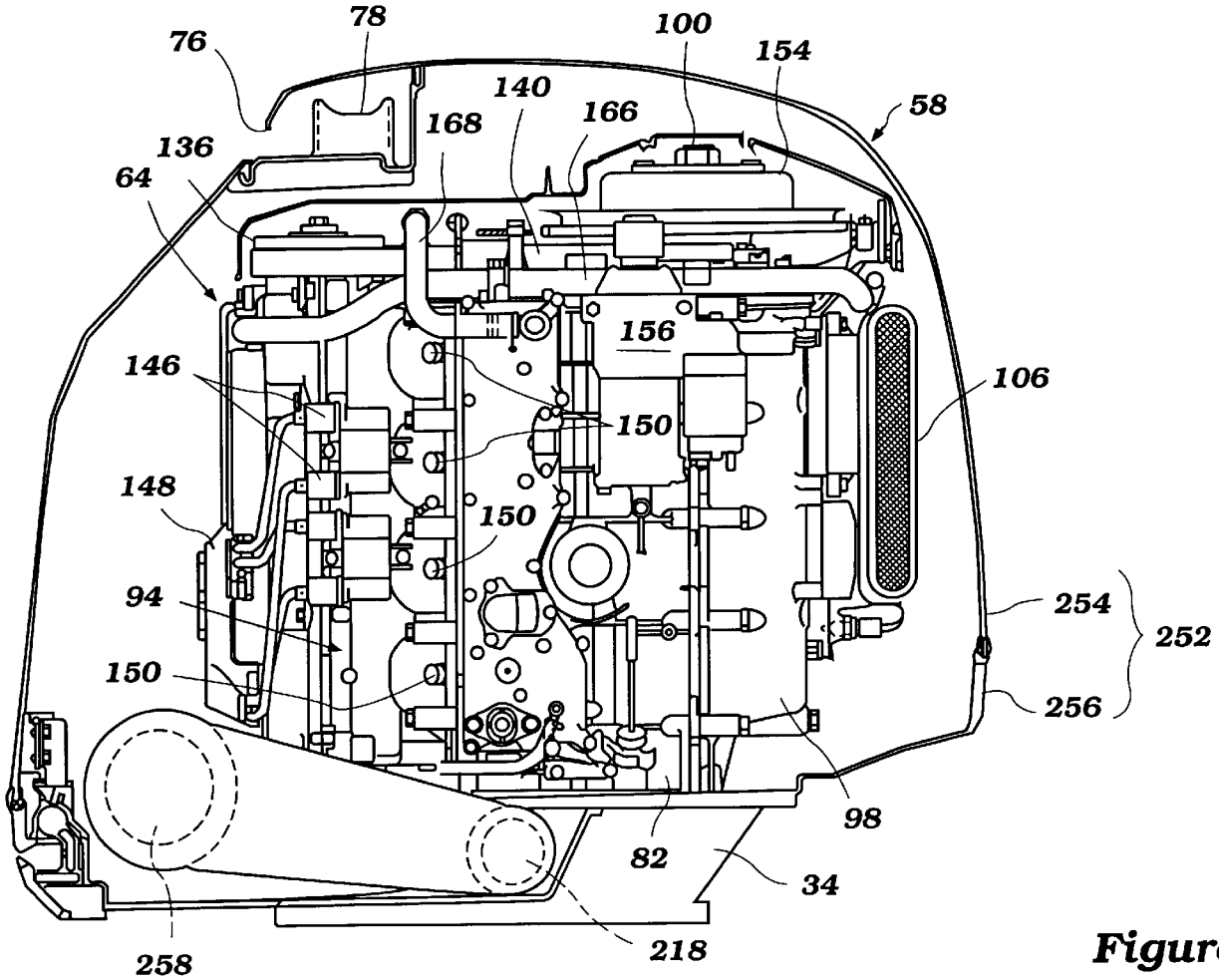
FIG. 5 is a side elevational view of a power head of another outboard motor that employs an exhaust unit configured in accordance with a second embodiment of the present invention.

With reference to FIG. 5, another exhaust unit 250 arranged in accordance with a second embodiment of the present invention will now be described. The same members and components that have been described in connection with the first embodiment will be assigned with the same reference numerals and will not be repeatedly described.

An exhaust unit 250 has substantially the same construction as the exhaust unit 32 of the first embodiment. However, it is completely enclosed by a protective cowling 252 which includes a top cowling member 254 and a bottom cowling member 256. That is, the catalyzer 258 is positioned slightly higher than the catalyzer 226 of the previous embodiment to extend toward the rear of the cylinder head assembly 94. Meanwhile, the protective cowling 252 extends downward to almost the same level of the bottom end of the exhaust guide 34.

The arrangement in the second embodiment can improve the appearance of the outboard motor 30 and may contribute to simplification of the cooling passage in the exhaust unit 250.

In both of the embodiments, the exhaust unit is mounted on the exhaust guide. However, this is not essential. The exhaust unit can be attached, for example, to a bottom portion of the engine or to a top portion of the driveshaft housing.

Also, the exhaust gases return to the exhaust passage formed in the exhaust guide after purified by the catalyzer of the exhaust unit in these embodiments. However, they may directly pass to the internal passage within the driveshaft housing by means of, for example, a separate conduit without passing through the exhaust guide. Additionally, the gases may, again without passing through the exhaust guide, directly move to the exhaust passage in the exhaust unit from the exhaust manifold formed within or out of the engine by means of a separate conduit. Thus, one or both of the internal passages in the exhaust guide may be omitted and the exhaust passage in the exhaust unit can directly connect to the exhaust manifold and/or to the internal passage of the driveshaft housing.

Further, the water passage does not necessarily surround the entire part of the exhaust passage in the exhaust unit. The water passage around the exhaust unit also need not communicate with the water jacket of the exhaust guide.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, various changes and modifications may be made without departing from the spirit and scope of the invention. It also is understood that various aspects of the embodiments can be combined and/or interchanged so as to form variations of the embodiments described. For example, the lower cowling member design of the embodiment of FIG. 5 can be used with the exhaust unit construction and arranged depicted in FIG. 3. Thus, it is intended that the scope of the present invention herein disclosed should not be limited by the particular disclosed embodiments described above, but should be determined only by a fair reading of the claims that follow.

What is claimed is:

1. An outboard motor comprising an internal combustion engine including a first exhaust passage, a driveshaft housing adapted to be mounted on an associated watercraft, an exhaust guide plate mounted on the driveshaft housing for supporting the engine above the driveshaft housing, a vertical space being defined below a surface of the engine and above an upwardly facing surface of the exhaust guide plate, an exhaust unit defining a second exhaust passage coupled to the first exhaust passage, the exhaust unit extending at least partially to a side of the exhaust guide plate and extending within the vertical space, and a catalyzer disposed in the second exhaust passage.

2. The outboard motor as set forth in claim 1, wherein the exhaust guide plate includes a third exhaust section that communicates with both the first and second exhaust passages.

3. The outboard motor as set forth in claim 1, wherein the exhaust guide plate includes a third exhaust section communicating with the second exhaust passage and; downstream thereof.

4. The outboard motor as set forth in claim 3, wherein the driveshaft housing includes a fourth exhaust section communicating with the third exhaust section.

5. The outboard motor as set forth in claim 1, wherein the exhaust unit is placed generally rearward of the exyhaust guide plate.

6. The outboard motor as set forth in claim 1, wherein the exhaust guide plate includes a projection extending rearward, and the exhaust unit is disposed generally over the projection.

7. The outboard motor as set forth in claim 1 additionally comprising a protective cowling surrounding the engine, and the exhaust unit being, at least in part, disposed within the protective cowling.

8. The outboard motor as set forth in claim 1, wherein the exhaust unit additionally includes a coolant passage juxtaposing at least the catalyzer.

9. The outboard motor as set forth in claim 1, wherein the exhaust unit additionally includes a coolant passage that generally extends around the second exhaust passage.

10. The outboard motor comprising an internal combustion engine including a first exhaust passage, a driveshaft housing adapted to be mounted on an associated watercraft, exhaust guide plate mounted on the driveshaft housing for supporting the engine above the driveshaft housing, an exhaust unit detachably connected to the side of the exhaust guide plate, the exhaust unit defining a second exhaust passage coupled to the first exhaust passage, and a catalyzer disposed in the second exhaust passage, the engine additionally including a plurality of cylinder bores extending generally horizontally and spaced apart generally vertically from each other, and a plurality of firing plugs corresponding to the respective cylinder bores, the exhaust unit being positioned lower than the lower-most firing plug.

11. The outboard motor as set forth in claim 10, wherein both the firing plugs and the exhaust unit are disposed generally on the same side of the outboard motor.

12. The outboard motor as set forth in claim 1, wherein the driveshaft housing has a third exhaust section communicating with the second exhaust passage and opening to the atmosphere, and the exhaust unit is positioned higher than the third exhaust section.

13. The outboard motor as set forth in claim 1, wherein the engine operates on a four-stroke combustion principle.

14. The outboard motor as set forth in claim 1, wherein the engine additionally includes a plurality of cylinder bores extending generally horizontally and spaced apart generally vertically from each other, and a plurality of firing plugs corresponding to the respective cylinder bores, the exhaust unit is positioned lower than the lower-most firing plug.

15. An outboard motor comprising an internal combustion engine including a first exhaust passage, a driveshaft housing adapted to be mounted on an associated watercraft, a lower unit housing depending from a lower end of the driveshaft housing, the lower unit housing supporting a portion of a propulsion unit,a support member mounted on the driveshaft housing for supporting the engine, the engine, the support member, and the driveshaft housing together defining a recess therebetween, an exhaust unit detachably mounted on the support member, at least a portion of the exhaust unit extending in the recess, the exhaust unit defining a second exhaust passage coupled to the first exhaust passage, and a catalyzer disposed in the second exhaust passage.

16. The outboard motor as set forth in claim 15, wherein the exhaust unit is placed generally rearward of the support member.

17. An exhaust gas purifying system for an outboard motor having an internal combustion engine and exhaust guide plate supporting the engine, comprising a first exhaust passage extending through both the engine and the exhaust guide plate, a second exhaust section coupled to the first exhaust passage, the second exhaust passage being defined in an outer exhaust unit disposed below the engine and next to the exhaust guide plate, a third exhaust passage coupled to the second exhaust passage and extending through the exhaust guide plate, and a catalyzer disposed in the second exhaust passage.

18. The exhaust gas purifying system as set forth in claim 16, wherein the exhaust unit is mounted on the exhaust guide plate.

19. The exhaust gas purifying system as set forth in claim 16, wherein at least a portion of the second exhaust passage where the catalyzer is positioned juxtaposes a coolant jacket.

20. The exhaust gas purifying system as set forth in claim 16, wherein the third exhaust section extends generally laterally.

21. An outboard motor comprising a power head that is disposed atop a driveshaft housing, the power head comprising an engine positioned within a protective cowling, a support member positioned between the power head and the driveshaft housing, the engine being supported above a portion of the support member, an exhaust manifold extending downward toward the support member and communicating with a first passage defined in the support member, a generally C-shaped exhaust unit extending rearward of a portion of the support member and being disposed above another portion of the support member, a catalyst being supported within the exhaust unit, a second passage being defined in the support member that routes exhaust downward toward said driveshaft housing, and the exhaust unit communicating with the first passage and the second passage of the support member.

22. The outboard motor of claim 21, further comprising a water jacket that extends along at least a portion of the exhaust unit.

23. The outboard motor of claim 21, wherein the exhaust unit is positioned completely above a lowermost surface of the support member.

24. The outboard motor of claim 21, wherein the exhaust unit is positioned between a lowermost surface of the support member and a lowermost spark plug associated with the engine.

25. The outboard motor of claim 21, wherein an outlet of the first passage and an inlet of the second passage are generally aligned along a transversely extending axis.

26. The outboard motor of claim 21, wherein an inlet of the first passage and an outlet of the second passage overlap in a top plan view.

27. The outboard motor of claim 26, wherein a center of the inlet of the first passage and a center of the outlet of the second passage are generally parallel and offset.

28. The outboard motor of claim 21, wherein at least a portion of the exhaust unit is disposed outside of the protective cowling.

29. The outboard motor of claim 28, wherein the portion of the exhaust unit that is outside of the protective cowling is disposed below a lower portion of the protective cowling.

30. An outboard motor comprising an internal combustion engine defining a first exhaust passage, therein, a housing unit adapted to be mounted on an associated watercraft, a support plate mounted on the housing unit to support the engine above the housing unit, an exhaust unit detachably mounted on the support plate, the exhaust unit defining a second exhaust passage therein that communicates with the first exhaust passage, the exhaust unit at least in part extending rearward relative to the support plated, and a catalyzer disposed in the second exhaust passage.

31. The outboard motor as set forth in claim 30, wherein the housing unit defining a third exhaust section communicating with the second exhaust passage.

32. The outboard motor as set forth in claim 30, wherein the exhaust unit includes a rear portion disposed rearward relative to the support plate, the catalyzer is positioned in the rear portion.

33. The outboard motor as set forth in claim 32, wherein the exhaust unit additionally includes side portions coupled with side surfaces of the support plate, the rear portion extends between the side portions.

* * * * *

UNITED STATES PATENT AND TRADEMARK OFFICE

CERTIFICATE OF CORRECTION

PATENT NO. : 6,729,921 B1
DATED : May 4, 2004
INVENTOR(S) : Yasushi Ishii

It is certified that error appears in the above-identified patent and that said Letters Patent is hereby corrected as shown below:

Title page,
Item [56], References Cited, U.S. PATENT DOCUMENTS, include
-- 5,556,311 09/17/1996 Fujimoto --
FOREIGN PATENT DOCUMENTS, include
-- 2001-073750 03/21/2001 Japan
DE 4234682 06/17/1996 Germany --

Signed and Sealed this

Fifth Day of October, 2004

JON W. DUDAS
*Director of the United States Patent and Trademark Office*

UNITED STATES PATENT AND TRADEMARK OFFICE

CERTIFICATE OF CORRECTION

PATENT NO. : 6,729,921 B1
DATED : May 4, 2004
INVENTOR(S) : Yasushi Ishii

It is certified that error appears in the above-identified patent and that said Letters Patent is hereby corrected as shown below:

Column 11,
Line 55, change "exyhaust", to -- exhaust --

Signed and Sealed this

Tenth Day of May, 2005

JON W. DUDAS
*Director of the United States Patent and Trademark Office*